US005086368A

United States Patent [19]

Gerke et al.

[11] Patent Number: 5,086,368

[45] Date of Patent: Feb. 4, 1992

[54] CONNECTOR BANK WITH VOLTAGE SURGE PROTECTION

[75] Inventors: Dieter Gerke; Lutz Biederstedt; Manfred Müller, all of Berlin, Fed. Rep. of Germany

[73] Assignee: Krone Aktiengesellschaft, Berlin, Fed. Rep. of Germany

[21] Appl. No.: 512,808

[22] Filed: Apr. 23, 1990

[30] Foreign Application Priority Data

May 23, 1989 [DE] Fed. Rep. of Germany ..... 3917270

[51] Int. Cl.[5] ..... H02H 9/04

[52] U.S. Cl. ..... 361/118

[58] Field of Search ..... 361/117, 118, 119

[56] References Cited

U.S. PATENT DOCUMENTS 4,313,147 1/1982 Uchida et al. ..... 361/119
4,504,883 3/1985 Uchida et al. ..... 361/119
4,741,711 5/1988 Singer, Jr. ..... 361/119
4,846,735 7/1989 Teichler et al. ..... 361/119
4,901,190 2/1990 Scholtholt ..... 361/119

*Primary Examiner*—Geoff Evans
*Attorney, Agent, or Firm*—McGlew & Tuttle

[57] ABSTRACT

A connector bank with two rows of insulation displacement contacts for connecting insulated conductors, in particular of cables for telecommunication and data systems, comprising a surge arrester magazine to be inserted into the connector bank. In order to provide a connector bank having a voltage surge protection and allowing connecting and disconnecting as well as testing the attached cable conductors at the insulation displacement contacts even with inserted voltage surge protection, the two rows of insulation displacement contacts are arranged on different sides of the connector bank. An insulation displacement contact of the first row is connected over a connecting element with an insulation displacement contact of the second row. The surge arrester magazine is arranged laterally approximately centrally between the two rows of insulation displacement contacts.

20 Claims, 3 Drawing Sheets

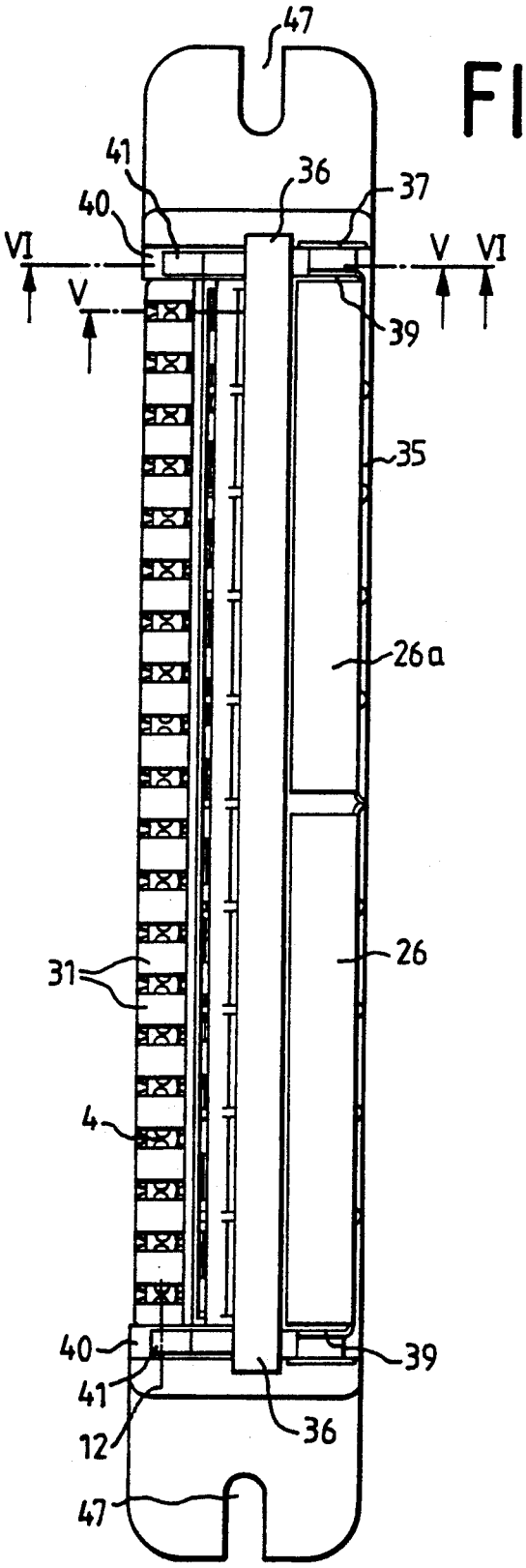
FIG.4
FIG.5
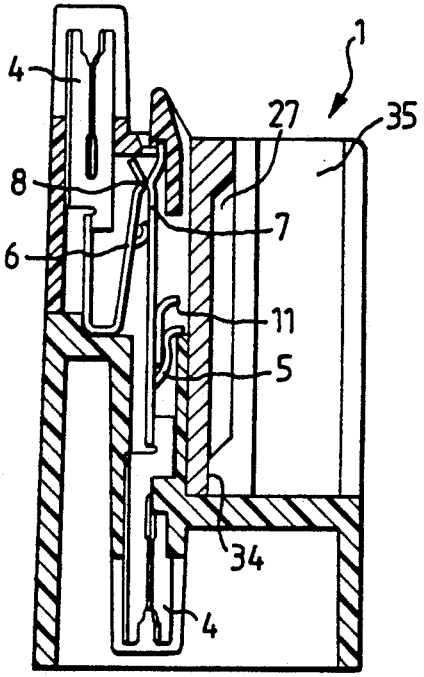

CONNECTOR BANK WITH VOLTAGE SURGE PROTECTION

FIELD AND BACKGROUNDS OF THE INVENTION

The invention relates to a connector bank with two rows of insulation displacement contacts for connecting insulated cable conductors and in particular to a connector bank for telecommunication and data systems including a surge arrester magazine which may be inserted into the connector bank and which comprises a connecting element which may be connected between two insulation displacement contacts associated with the rows.

A connector bank of this type is known in the art from DE-PS 28 11 812. This reference discloses a connector bank provided with two parallel rows of insulation displacement contacts serving to connect insulated cable conductors. For protection against voltage surges of such cable conductors, a surge arrester magazine is insertable into the connector bank. Contact tongues arranged at the surge arrester magazine are connected to the insulation displacement contacts. The contact tongues are connected with the surge arresters disposed in the housing of the surge arrester magazine. It is disadvantageous with the connector bank that the insulation displacement contacts are completely covered by the surge arrester magazine and are, thus, not accessible anymore. Removing the connected cable conductors or attaching still free contact elements is only possible after pulling the surge arrester magazine off.

Further, functional tests of the connected cable conductors by means of a test plug are also possible only after pulling the surge arrester magazine off. Another disadvantage is that such an arrangement will, due to its construction height, require a correspondingly large housing for accommodating connector banks provided with surge arresters.

From DP-PS 35 09 523, there is known another connector bank with two rows of insulation displacement contacts and a surge arrester magazine to be connected with the connector bank. Here, too, one row of insulation displacement contacts is completely covered by the magazine such that the cable conductors connected therewith are not accessible.

From DE-PS 29 43 578 there is known a connector bank having opposed rows of connecting contacts. However, this reference odes not disclose a voltage surge protection arrangement.

SUMMARY AND OBJECTS OF THE INVENTION

It is an object of the invention to provide a connector bank with a surge voltage protection arrangement, for which connecting and disconnecting and testing the attached cable conductors at the insulation displacement contacts is possible even with a surge voltage protection module or the like inserted. It is also an object to provide the dimensions of the connector bank such that the connector bank is insertable also into flat-design housing bodies.

According to the invention, the two rows of insulation displacement contacts are provided associated with the connector bank arranged on different sides of the connector bank. The surge arrestor magazine is arranged laterally approximately centrally between the two rows of the insulation displacement contacts.

The connector bank is built up such that the two rows of insulation displacement contacts are arranged on different sides of the connector bank. The surge arrester magazine is arranged laterally approximately centrally between the two rows of insulation displacement contacts. This provides an advantageous, space-saving arrangement. The two rows of insulation displacement contacts are freely accessible even after inserting the surge arrester magazine, so that connecting as well as disconnecting the cable conductors attached adjacent the arrester magazine is possible. Testing the conductor connection by means of test devices is also possible.

According to an advantageous feature of the invention, the bottom side of the connector bank is provided forming a chamber. The chamber provides a location for the second row of insulation displacement contacts. By this arrangement potting of cable conductors connected with the bottom row of insulation displacement contacts is possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 is a top view of the connector bank according to the embodiments of FIGS. 1-3;

FIG. 5 is a cross-sectional view taken along line V—V in FIG. 4;

FIG. 6 is a sectional view taken along line VI—VI in FIG. 4 showing a swivel hook; and, FIG. 7 is a sectional view taken along line VI—VI showing the swivel hook turned on.

DETAILED DESCRIPTION OF THE PREFERRED EMBODIMENTS

Figure 1:
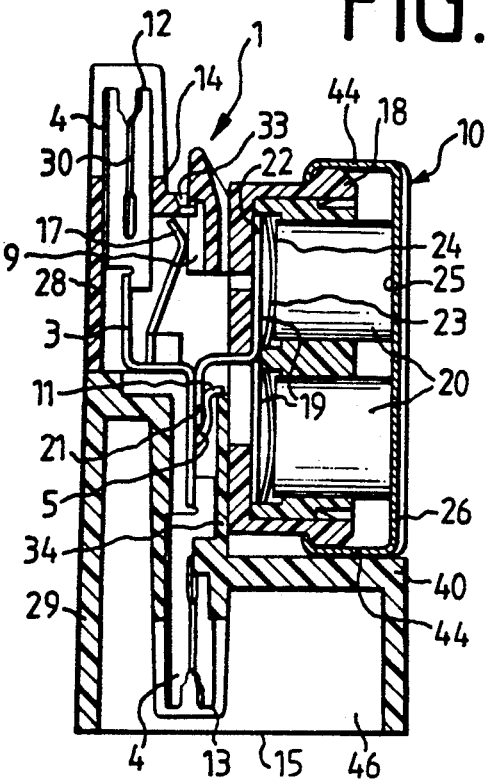
FIG. 1 is a cross-sectional view through a connector bank according to a first embodiment of the invention.

The connector bank 1 shown in the figures is composed of a bank body made of plastic. The bank body includes an upper section 28 and a lower section 29. Disposed laterally to the connector bank 1, there is arranged a surge arrester magazine 10 which is inserted from above. In the connector bank 1 there are supported insulation displacement contacts 4. The insulation displacement contacts 4 are provided to connect insulated cable conductors or paper-insulated cable conductors (not shown). The insulation displacement contacts 4 are made in a known manner, formed of metal material and provided with a contact slot 30. An insulated cable conductor is pressed into the contact slot 30 by means of a non-shown tool. When pressing the cable conductor into the contact slot 30, the insulation of the cable conductor is cut through, and a contact connection between the conductive core of the cable conductor and the insulation displacement contact is established. Several insulation displacement contacts 4 are arranged one behind the other in a first row 12. The insulation contacts 4, arranged side by side, are separated from one another by clamping pieces 31, as shown in FIG. 4. On the opposite side of insulation displacement contacts 4, relative to the first row 12, there is arranged a second row 13 of insulation displacement contacts 4. As is shown in FIG. 1, the first row 12 of insulation displacement contacts 4 is arranged at the top side 14 of the connector bank 1, and the second row 13 of insulation displacement contacts 4 is arranged at the bottom side 15 thereof.

Each insulation displacement contact 4 of the first row 12 is connected with an insulation displacement contact 4 of the second row 13 over a connecting element 3. Accordingly the cable conductors connected to the insulation displacement contacts 4 are also connected to each other.

Figure 2:
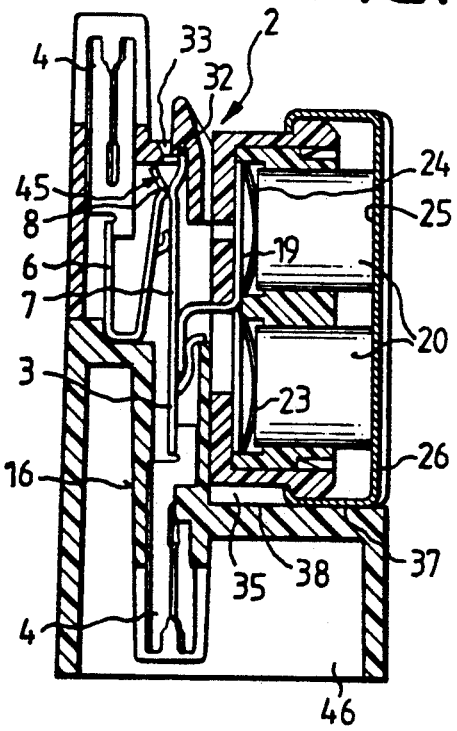
FIG. 2 is a cross-sectional view through the connector bank with a separating contact according to a second embodiment of the invention.

In the second embodiment shown in FIG. 2, the connecting element 3 is formed as a two-piece element. This connecting element has two contact springs 6, 7 abutting against each other. The contact springs form a separation position 8. The connector bank 1 is thus built up as a disconnector bank 2. The contact spring 7 of the connecting element 3 is connected with the insulation displacement contact 4 of the second row. The contact end 32 of the contact spring 7 is inserted into a slot 9 of the connector bank 1 and is held immovably. The contact spring 6 is formed as a one-piece U-shaped separating contact 45 together with the insulation displacement contact 4 of the first row 12. The contact spring 6 rests resiliently against the contact spring 7, and forms a separation position 8. Flush with the separation position 8 there is provided an opening 33 in the connector bank 1. Through this opening a non-shown plug is insertable for testing or separating the contact springs 6, 7.

Figure 3:
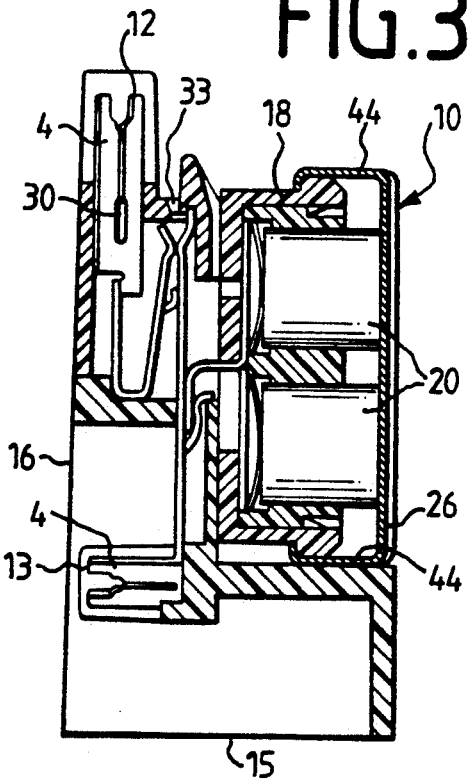
FIG. 3 is a cross-sectional view through the connector bank according to a third embodiment of the invention.

In the third embodiment (see FIG. 3), the insulation displacement contact 4 of the second row 13 is bent off by 90° toward the front side 16 of connector bank 1. This allows the possibility of attachment of the cable conductors from the front side 16. Such a connector bank 1, as shown in FIG. 3, is employed in particular for cases where the attachment of the connector bank 1 is effected on a plan support or where the bottom side 15 of the connector bank 1 is not accessible.

In the connector banks 1 of all three embodiments, there is provided laterally at one housing side 34 a receiving chamber 35 for the surge arrester magazine 10. Such receiving chamber 35 is provided with a receiving groove 27 extending in parallel to the first row 12 of insulation displacement contacts 4. The surge arrester magazine 10 is inserted in the receiving groove 27. For this purpose, the surge arrester magazine comprises two projections 36 protruding over the front-side ends. The bottom side 37 of the surge arrester magazine 10 rests upon the housing bottom 38 of the receiving chambers 35.

The surge arrester magazine 10 comprises several surge arresters 20 arranged in two parallel rows. Each surge arrester 20 is assigned to a pair of insulation displacement contacts 4 of the top and bottom sides 14, 15. The electrical connection to the insulation displacement contacts 4 is effected over contact tongues 11 supported in the surge arrester magazine 10. The contact tongues 11 are preferably S-shaped. The one end 22 of the S-shaped contact tongue 11 serves as contact surface 19 for the one pole side 24 of the surge arrester magazine 20. The other end of the S-shaped contact tongue 11 projects from the housing 18 of the surge arrester magazine 10, and is inserted between a clamping contact 5 and the connecting element 3. The clamping contact 5 is hook-shaped, and is formed as a one-piece element together with the connecting element 3. Between the contact surface 19 of the contact tongue 11 and the first pole side 24 of the surge arrester 20, there is arranged a clamping spring 23 pressing the surge arrester 20 with the second pole side 25 against an earthing plate 26, **26*a*. The earthing plate 26, 26*a* is formed as a U-shaped metal bracket, and is composed, as shown in particular in FIG. 4, of two partial plates which slide from the front side on the surge arrester magazine 10. At the front sides of the earthing plate 26, 26*a*, sheet-metal lugs 39 are bent off, and are connected with a non-shown earth terminal. The side walls 44 of the earthing plate 26, 26*a* are bent off, thus the earthing plate 26, 26*a* is fixedly held at the housing 18 of the surge arrester magazine 10. In case of an over-voltage, the voltage surge flowing over the contact tongue through the surge arrester 20, is carried away over the earthing plate 26, 26*a*** and the earth terminal.

Figure 6:
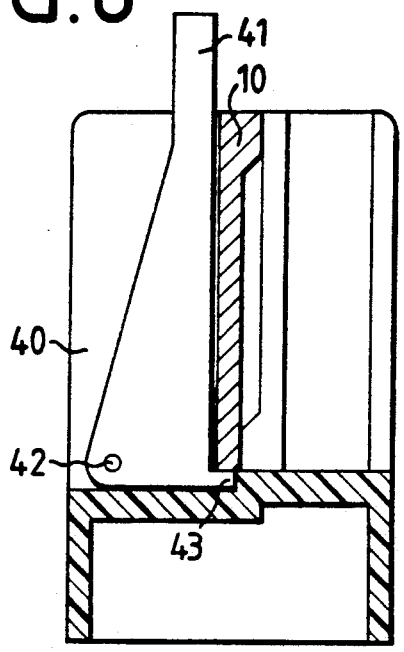
Figure 7:
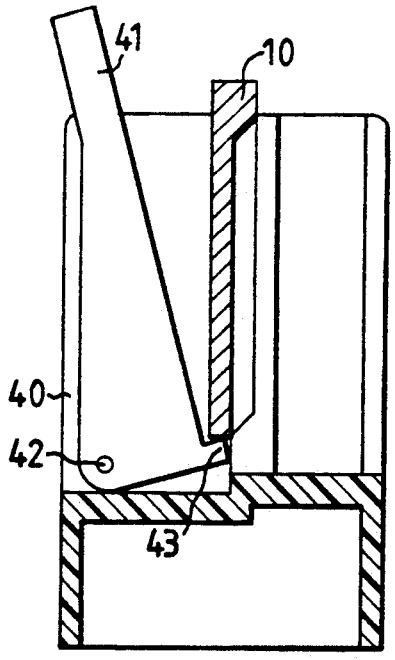

For pulling the surge arrester magazine 1 off from the connector bank 1, there are provided laterally receiving slots 20. These laterally receiving slots 20 accommodate a lever 41 shown in particular in FIGS. 6 and 7. The lever 41 comprises a hook 43 inserted under the surge arrester magazine 10. By turning the lever 41 about a point of rotation 41, the surge arrester magazine 10 can be snapped out toward the top. The contact connection between the clamping contacts 5 and the contact tongues 11 is, thus, loosened.

The connector bank 1 can preferably be employed in a non-shown distribution terminal or cable box. The connector bank 1 is fixed by means of screws which are received in the lateral slots 47 of the connector bank 1 to a frame structure or to a mounting plate. Within the distribution terminal there can be provided up to twenty connector banks 1.

While specific embodiments of the invention have been shown and described in detail to illustrate the application of the principles of the invention, it will be understood that the invention may be embodied otherwise without departing from such principles.

What is claimed is:

1. A connector bank particularly for telecommunication and data systems, comprising: a connector bank body defining a plurality of connector bank sides; two rows of insulation displacement contacts, each of said rows being provided on a different side of said connector bank body; said connector bank body defining an arrestor magazine receiving chamber disposed laterally of a first of said two rows of insulation displacement contacts; a plurality of connecting elements, each connecting element being connected to a displacement contact of each of said two rows of displacement contacts, said connecting elements each being positioned adjacent said arrester magazine receiving chamber; and, an arrester magazine inserted in said arrestor magazine receiving chamber and connectable to said connecting elements.

2. A connector bank according to claim 1, wherein each connecting element includes a clamping contact, said surge arrestor magazine including a contact tongue insertable into said clamping contact, said clamping contacts extending laterally of said connector bank.

3. A connector bank according to claim 1, wherein each of said connecting elements is formed as a two piece contact spring, each contact spring piece abutting another contact spring piece, each contact spring being displaceable to form a separation position.

4. A connector bank according to claim 1, wherein a first of said rows of insulation displacement contacts is arranged at a top side of said connector bank body and a second row of said rows of insulation displacement contacts is arranged at a bottom side of said connector bank body.

5. A connector bank according to claim 1, wherein a first row of said rows of insulation displacement contacts is arranged at a top side of said connector bank body and a second row of said rows of insulation displacement contacts is arranged at a front side of said connector bank body.

6. A connector bank according to claim 1, wherein each arrester magazine includes a contact tongue having one end projecting from a housing of the surge arrester magazine for contacting the connector bank and having another end formed as a contact surface for contacting a surge arrester.

7. A connector bank according to claim 1, wherein each arrester magazine includes a contact tongue and at least one surge arrester and a clamping spring positioned between a first pole of said surge arrester and said contact tongue.

8. A connector bank according to claim 7, wherein a second pole side of each surge arrester is positioned in contact with an earthing plate, said earthing plate being fixed over bent-off side walls.

9. A connector bank according to claim 1, wherein a spring contact is connected to said connecting element for providing a test position of said connecting element.

10. A connector bank according to claim 1, wherein a receiving groove is provided for holding said surge arrester magazine, said receiving groove being provided in said connector bank body extending in parallel with each of a first and second row of said rows of insulation displacement contacts.

11. A connector bank according to claim 1, wherein a bottom side of said connector bank is provided defining a chamber for potting the cable conductors connected to a second row of said rows of insulation displacement contacts.

12. A connector according to claim 1 wherein said arrester magazine receiving chamber is positioned between said first and second rows of insulation displacement contacts.

13. A telecommunication and data systems connector bank, comprising: a connector bank body defining a top and a bottom side, a front and a rear side, the end sides; a fist row of insulation displacement contacts, said first row being provided extending outwardly from said top side of said connector bank body and defining a wire insertion direction at said top side of said connector bank body; a second row of insulation displacement contacts, said second row of insulation displacement contacts extending outwardly from one of said front, back and rear sides of said connector bank body and defining an insertion direction of said second row of insulation displacement contacts at said one of said front side, rear side and body side; an arrester magazine receiving chamber defined by said connector bank body laterally of said first row of insulation displacement contacts; a plurality of connecting elements, each connecting element being connected to a displacement contact of said first row of displacement contacts and being connected with a displacement contact of said second row of displacement contacts, said connecting elements each having a portion positioned adjacent said arrester magazine receiving chambers; and, an arrester magazine inserted in said arrester magazine receiving chamber connected to said portion of said connecting elements.

14. A connector bank according to claim 13, wherein each of said connecting elements is formed as a two piece contact spring, each contact spring piece abutting another contact spring piece, said contact spring being displacable to form a separation position, said two piece contact spring being positioned adjacent an opening in said connector bank for access to said two piece contact spring.

15. A connector bank according to claim 13, wherein each connecting element includes a clamping contact, said surge arrester magazine including a contact tongue insertable into said clamping contact, said clamping contact extending laterally of said connector bank between said first and second rows of insulation displacement contacts.

16. A connector bank according to claim 13, wherein said connecting element extends into said arrester magazine receiving chamber between said first and second rows of insulation displacement contacts.

17. A telecommunication of data systems connector bank, comprising: a connector bank body defining a top side, a bottom side, a front side, a rear side and first and second end sides; a first row of insulation displacement contacts provided on a top side of said connector bank body; an access cavity defined by said connector bank body including a connector bank body recessed support surface located recessed from one of said front side, rear side and bottom side of said connector bank body; a second row of insulation displacement contacts, said second row of insulation displacement contacts being connected to said recessed support surface; an arrester magazine receiving chamber defined by said connector bank body, said arrester magazine receiving chamber being displaced laterally of said first row of insulation displacement contacts; a plurality of connecting elements, each connecting element being connected to a displacement contact of each of said first row of displacement contacts and said second row of displacement contacts, said connecting element each extending to a location adjacent said arrester magazine receiving chamber; and, an arrester magazine inserted in said arrester magazine receiving chamber and connectable to said connecting elements.

18. A connector bank according to claim 17, wherein said cavity is provided extending inwardly from said bottom side of said connector bank body, said second row of insulation displacement contacts extending from said recessed support surface toward said bottom side and terminating at a location spaced inwardly from said bottom side.

19. A connector bank according to claim 17, wherein said cavity is provided extending inwardly from said front side of said connector bank body, said second row of insulation displacement contacts extending from said recessed support surface toward said front side and terminating at a location spaced inwardly from said front side.

20. A connector bank according to claim 17, wherein said connecting element extends into said arrester magazine receiving chamber between said first and second rows of insulation displacement contacts.

* * * * *